US011014377B2

(12) United States Patent
Ruppaner et al.

(10) Patent No.: US 11,014,377 B2
(45) Date of Patent: May 25, 2021

(54) SHEET-FED PRINTING MACHINE WITH A HUMIDIFICATION DEVICE

(71) Applicant: HEIDELBERGER DRUCKMASCHINEN AG, Heidelberg (DE)

(72) Inventors: Christoph Ruppaner, Kraichtal (DE); Claudius Haas, Steinach (DE); Markus Leva, Darmstadt (DE); Uwe Angst, Jockgrim (DE); Ulrich Fellenberg, Oftersheim (DE); Edmund Klein, Neckargemuend (DE); Andreas Boettger, Heidelberg (DE); Sebastian Wilhelm, Schwetzingen (DE); Peter Hachmann, Weinheim-Hohensachsen (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 16/503,780

(22) Filed: Jul. 5, 2019

(65) Prior Publication Data

US 2020/0009883 A1 Jan. 9, 2020

(30) Foreign Application Priority Data

Jul. 5, 2018 (DE) ..... 102018211079.4

(51) Int. Cl.
*B41J 11/00* (2006.01)

(52) U.S. Cl.
CPC ..... *B41J 11/0015* (2013.01)

(58) Field of Classification Search
CPC .. B41J 11/002; B41J 11/0015; B41F 23/0466; B41F 23/0456; B41F 23/02; B41F 21/08
USPC ..... 347/102
See application file for complete search history.

(56) References Cited

U.S. PATENT DOCUMENTS

| | | | | |
|---|---|---|---|---|
| 7,152,528 | B2 | 12/2006 | Hesterman | |
| 2011/0279612 | A1* | 11/2011 | Muro et al. | B41J 11/0015 |
| 2012/0075366 | A1* | 3/2012 | Kanome et al. | B41J 2/16479 |
| 2015/0043998 | A1 | 2/2015 | Janssen et al. | |

FOREIGN PATENT DOCUMENTS

| | | | |
|---|---|---|---|
| DE | 10144159 | A1 | 3/2003 |
| DE | 10312870 | A1 | 2/2004 |
| DE | 102015222753 | A1 | 5/2017 |
| DE | 102016125960 | A1 | 7/2017 |
| DE | 102017208745 | A1 | 11/2017 |
| FR | 1496302 | A | 9/1967 |
| WO | 2013160167 | A1 | 10/2013 |

* cited by examiner

*Primary Examiner* — Huan H Tran
*Assistant Examiner* — Alexander D Shenderov
(74) *Attorney, Agent, or Firm* — Laurence A. Greenberg; Werner H. Stemer; Ralph E. Locher

(57) ABSTRACT

A sheet-fed printing machine contains a printing unit, a drier, and a sheet handling device for transporting or guiding print sheets. The sheet handling device has an opening disposed downstream of the drier in the direction of transport. A humidification device for rehumidifying the print sheets is disposed in such a way that it rehumidifies the print sheets through the opening. The sheet handling device may contain a guide plate or several guide plates.

14 Claims, 9 Drawing Sheets

SHEET-FED PRINTING MACHINE WITH A HUMIDIFICATION DEVICE

CROSS-REFERENCE TO RELATED APPLICATION

This application claims the priority, under 35 U.S.C. § 119, of German application DE 10 2018 211 079.4, filed Jul. 5, 2018; the prior application is herewith incorporated by reference in its entirety.

BACKGROUND OF THE INVENTION

Field of the Invention

The present invention relates to a sheet-fed printing machine containing a printing unit, a drier, and a sheet handling device for transporting or guiding print sheets.

Sheet handling devices for transporting print sheets are, for instance, sheet-transporting drums and conveyor belts. Sheet handling devices for guiding print sheets are, for instance, sheet-guiding plates.

Published, non-prosecuted German patent application DE 10 2016 125 960 A1 discloses a sheet-fed printing machine with printing units in which inkjet print heads are used. A respective sheet-transporting drum interacting with a sheet-guiding path is disposed between the printing units. A drying unit including infrared or hot-air driers is disposed downstream of the last printing unit. A varnishing module for coating the print sheets as a final step is provided downstream of the drying unit.

A disadvantage is that the infrared or hot-air driers dehumidify the print sheet, resulting in the occurrence of sheet deformation. However, the application of varnish in the varnishing module cannot reintroduce the moisture because the varnish is applied to the print that has previously been printed in the printing units and has a sealing effect on the print sheets.

SUMMARY OF THE INVENTION

An object of the invention is to provide a sheet-fed printing machine that avoids sheet deformation caused by the drier The object is attained by a sheet-fed printing machine containing a printing unit, a drier, and a sheet handling device for transporting or guiding print sheets wherein the sheet handling device has an opening disposed downstream of the drier in terms of the direction of sheet transport and wherein a humidification device for rehumidifying the print sheets is disposed in such a way that the humidification device rehumidifies the print sheets through the opening.

An advantage of the sheet-fed printing machine of the invention is that the rehumidification by the humidification device may occur on the sheet side that the printing unit has not printed on and which may therefore easily absorb the rehumidification liquid.

Various further developments are possible:

a) The opening may be formed by a window in the sheet handling device or by a gap between two components of the sheet handling device.
b) The humidification device may include a spraying device.
c) The drier may be a thermal drier such as an infrared or hot-air drier
d) The printing unit may comprise at least one ink jet print head.

e) The sheet handling device may comprise at least one sheet-guiding plate that delimits the opening.
f) The sheet handling device may comprise at least one conveyor belt that delimits the opening.
g) The humidification device may comprise a format adjustment device for adapting the effective humidification width of the humidification device to the width of the respective format of the print sheets.
h) The format adjustment device may comprise at least one format cover.
i) The humidification device may have a timing device for generating a spraying cycle.
j) The timing device may comprise a cyclic cover.
k) The humidification device may have a housing and a feed line for feeding a fluid to the housing and the timing device may include an actuator for alternately aligning an outlet of the feed line in an active position and a passive position.
l) The timing device may comprise a blower device directed towards at least one spray jet of the humidification device. While a sheet gap between two successive print sheets passes, the blower device may blow through the sheet gap towards the spray jet in such a way that the latter is deflected.
m) The humidification device may comprise a row of spin trays for creating spray jets.
n) The length of the opening in the direction of sheet transport may be a maximum of 30% of a sheet length of the maximum format of print sheets that may be processed in the sheet-fed printing machine, Other features which are considered as characteristic for the invention are set forth in the appended claims.

Although the invention is illustrated and described herein as embodied in a sheet-fed printing machine with a humidification device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

In all figures, components and elements that correspond to one another have the same reference symbol. Therefore, the description of these components and elements need not be repeated.

Figure 1:
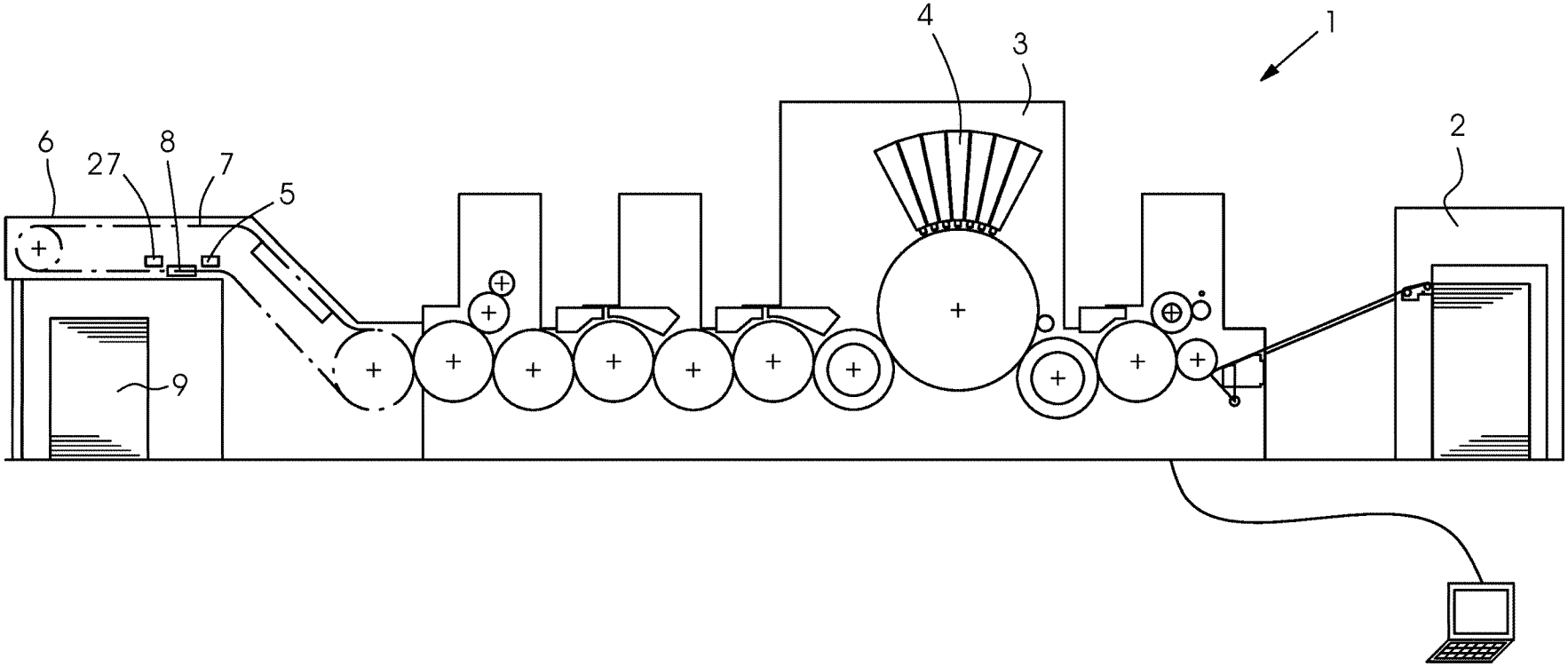
FIG. 1 is a diagrammatic, side view of a sheet-fed printing press with a humidification device according to the invention.

Referring now to the figures of the drawings in detail and first, particularly to FIG. 1 thereof, there is shown a sheet-fed printing machine 1 having a sheet feeder 2, a printing unit 3 with inkjet print heads 4 for multicolor printing, a dryer 5, and a sheet delivery 6. The printing machine further has a transport device 7 for transporting the print sheets past a humidification device 8. The transport device 7 is a chain conveyor and is disposed in the sheet delivery 6.

The drier 5 is a thermal drier emitting hot air and/or infrared light towards the print sheets to dry the inkjet printing ink thereon. The humidification device 8 is a rehumidification device used to rehumidify the print sheets. Irradiation by the drier 5 causes the substrate of the print sheet, e.g. the paper or cardboard, to lose moisture. This is an unavoidable side effect that would lead to undesired sheet deformation if no countermeasures were taken. The countermeasure in the form of a rehumidification at least partly compensates for the moisture loss caused by the drying process.

The humidification device 8 is disposed in the sheet delivery 6 and humidifies the print sheets after they have been treated by the drier 5 but before powder is applied to the print sheets by a powdering device 27. Finally, the print sheets are deposited on a sheet stack 9 they form in the sheet delivery 6.

Figure 2A:
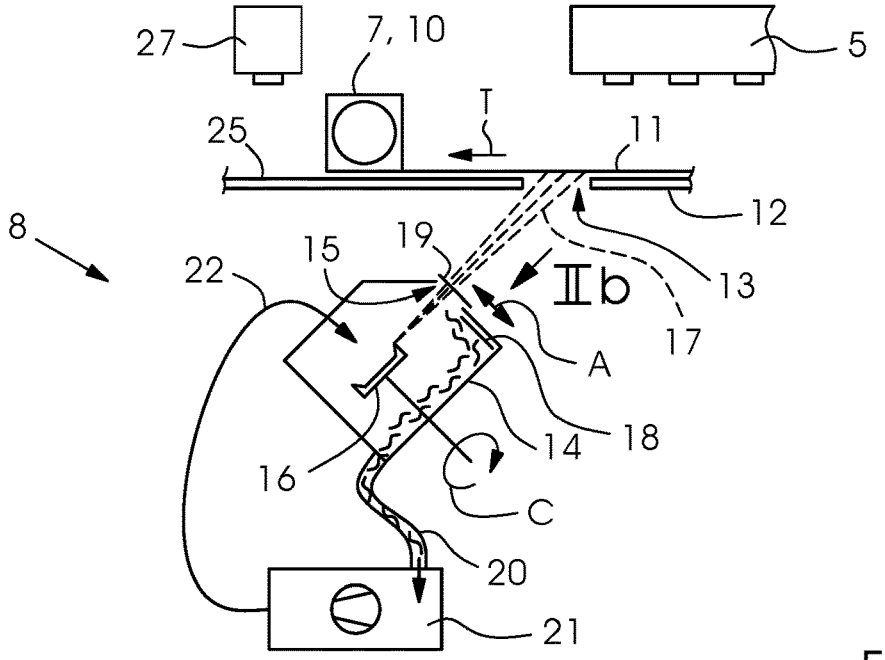
FIGS. 2A to 3B are illustrations of different views and positions of the humidification device in accordance with a first exemplary embodiment.
Figure 2B:
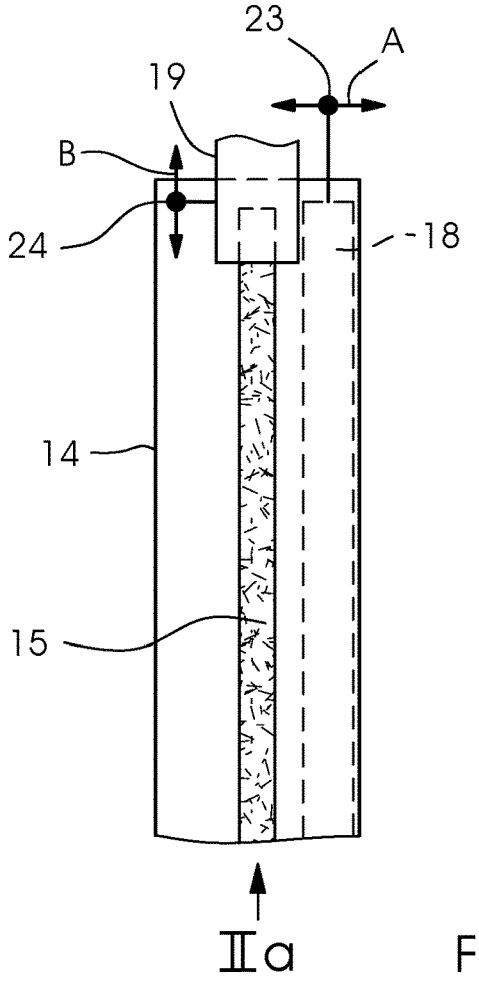

FIGS. 2A and 2B illustrate details of the humidification device 8; FIG. 2*a* is a side view in accordance with viewing direction IIa and FIG. 2B is a top view in accordance with viewing direction IIb. The transport device 7 contains gripper bars 10 for holding, namely clamping, the leading edges of print sheets 11. Each gripper bar 10 drags the print sheet 11 along a guide device 12 that pneumatically guides the print sheet by suction air and/or blown air. For this purpose, a guide surface 25 of the guide device 12 is configured as a nozzle surface with nozzles formed therein to aspirate suction air or emit blown air. Alternatively, the guide device 12 may guide the print sheets mechanically. In this case, the guide surface 25 is embodied as a sliding surface. The guide surface 25 is flat and may alternatively have a cup-like shape or a concave shape if the transport device 7 was a drum. The guide device 12 may specifically be referred to as a sheet-guiding plate.

In the guide device 12 there is a passage 13 through which the humidification device 8 humidifies the print sheet 11 in what is referred to as the cycle phase (active phase). The humidification device 8 is located below the guide device 12 and dampens the print sheet 11 side facing the guide device 12 as the print sheet 11 is located above the guide device 12 and guided by the latter. Thus the humidification device 8 humidifies the bottom or rear or unprinted side of the print sheet 11 from below. Applying moisture to this sheet side is advantageous in terms of a better moisture absorption by the print sheet.

The opening 13 may be a window or alternatively—if the guide device 12 has multiple parts and consists of plates disposed behind one another in the direction of sheet transport T—a gap between two plates. The humidification device 8 contains a housing 14 including a row of spin trays 16. The row of trays is horizontal and perpendicular to the direction of sheet transport T. Only one spin tray 16 of the row is visible in the drawing. Every spin tray 16 generates a fan-shaped or cone-shaped fluid spray jet 17 intended to humidify the print sheet 11. Having exited the housing, the spray jets 17 merge to form a single spray curtain that extends over the entire width of the print sheet. The fluid is water, potentially with additives. When the sheet is humidified in the cycle phase, the spray jets 17 exit through a spray opening 15 in a housing 14 and pass through the opening 13.

A cyclic cover 18, which may also be referred to as a dynamic shutter, is periodically alternated between a first position and a second position in accordance with the conveying cycle of the print sheets 11. This adjustment is achieved by a drive 23, which is only schematically shown in FIG. 2B and indicated as a translatory movement A by a double-headed arrow. The drive 23 may, for example, comprise a pneumatic operating cylinder or alternatively an electric motor with a downstream transmission such as a cam mechanism. In the first position, which is shown in FIGS. 2A and 2B, the cyclic cover 18 does not cover the spray opening 15, which is therefore open, so the spray jets 17 are not blocked by the cyclic cover 18. In the first position, which corresponds to the cycle phase, the print sheet 11 covers the opening 13, causing the passing print sheet 11 to be humidified from the front to the back.

Figure 3A:
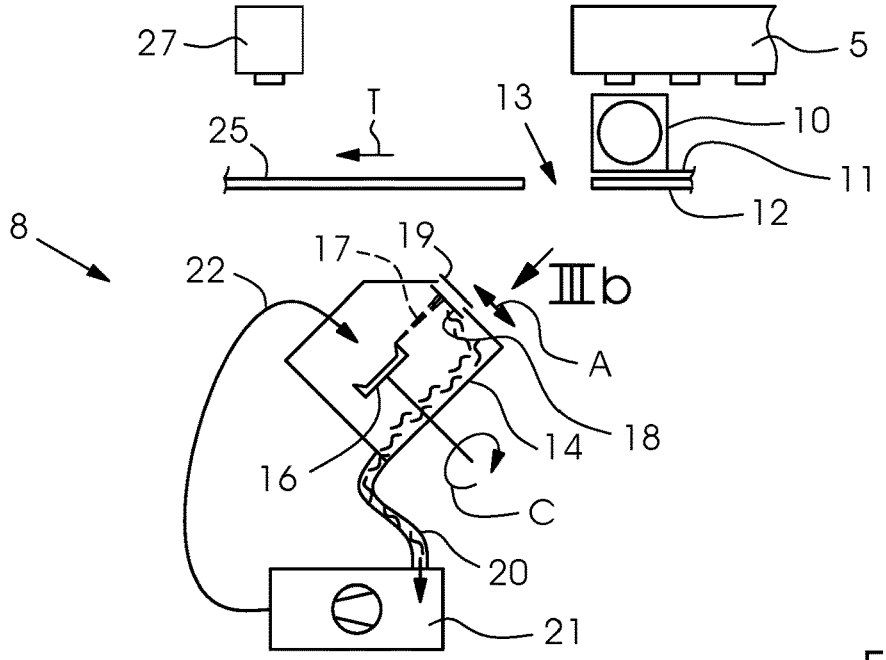
Figure 3B:
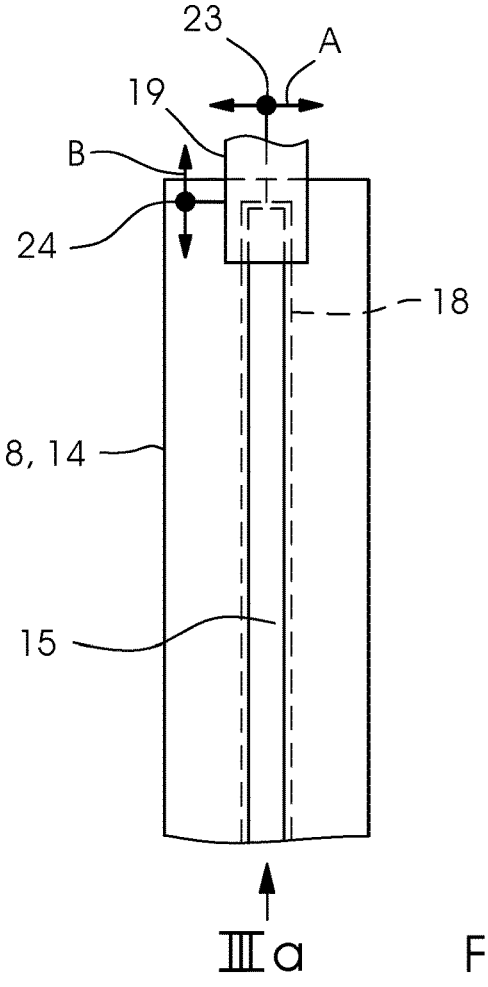

FIGS. 3A and 3B illustrate the humidification device 8 in what is referred to as the channel phase (passive phase) in which the opening 13 is not covered by a print sheet 11. In the channel phase, a gap—also referred to as a channel—between the trailing edge of a leading print sheet and the leading edge of a trailing print sheet 11 covers the opening 13. The channel phase corresponds to the second position of the cyclic cover 18, which at the same time covers the spray opening 15 and closes the latter, causing the spray jets 17 to hit the cyclic cover 18, which prevents them from exiting the housing 14. This prevents the humidification device 8 from spraying into the sheet gaps; such a spraying action would mean a waste of fluid and contamination of the machine. The cyclic cover 18 has the shape of a stripe that is slightly longer and wider than the slot-shaped spray opening 15 to cover the latter completely.

At the minimum, the length of the spray opening 15 (in a direction orthogonal to the plane of the drawing) corresponds to the width of the maximum sheet format that is processable in the sheet-fed printing machine 1. To prevent the humidification device 8 from spraying laterally past a print sheet 11 whose format is smaller than the maximum sheet format, the humidification device 8 has a format adjustment device with two format covers 19 that may be adjusted towards and away from one another by a drive 24. One format cover 19 is located on a spray opening 15 end located on the drive side of the printing machine 1 to partly cover the spray opening 15 and the other format cover is located on a spray opening 15 end on the operator side of the printing machine 1 likewise to partly cover the spray opening 15. The spray jets 17 emitted by the spin trays 16 outside the width of the sheet format to be processed or parts thereof hit the format covers 19, which prevent them from exiting the housing 14. Only one of the two format covers 19, each of which is wider than the spray opening 15, is shown in the drawing. During a print job, every format cover 19 maintains its position that was set for the sheet format of the print job without any changes. Thus it may be referred to as a static shutter. The drive 24 may be an electric motor with a transmission such as a worm gear connected downstream. The adjustment of the respective format cover 19 occurs in a direction perpendicular to the direction of sheet transport T at a translation B.

Both in the cycle phase and in the channel phase, the spin trays 16 carry out an uninterrupted rotation C, which may be driven by a common motor or by a separate motor for every spin tray 16.

The housing 14, together with a pump 21, is part of a fluid circuit. Via a feed line 22, the pump 21 pumps the fluid 22 into the housing 14 and onto the spin trays 16. The feed line 22 may branch off into a plurality of branches, each of the outlets of which may be oriented towards a different spin tray 16. The spin trays 16 generate the spray jets 17 due to the centrifugal effect. An exhaust line 20 connecting the housing 14 to the pump 21 leads the excess fluid, which is blocked by the covers 18, 19 and runs off in the housing 14, from the housing 14 to the pump 21. The lines 20, 22 may be pipes or hoses.

Figure 4:
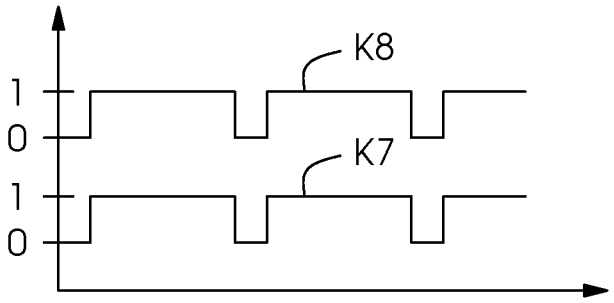
FIG. 4 is a diagram illustrating a periodic and discontinuous operation of the humidification device and universally valid for all exemplary embodiments.

FIG. 4 is a diagram illustrating the synchronism between the spraying cycle K8 of the humidification device 8 and the conveying cycle K7 of the transport device 7. The x-axis is the time axis. With respect to the curve with the conveying cycle K7, the value 1 on the y-axis indicates the presence of a print sheet in the region of an opening 13 and the value 0 indicates the presence of a sheet gap (between two print sheets) in the region of the opening 13. With respect to the curve with the spraying cycle K8, the value 1 on the y-axis indicates the cycle phase, i.e. when the humidification device 8 sprays through the opening 13, and the value 0 indicates the channel phase, i.e. when the humidification device 8 does not spray through the opening 13.

Figure 5:
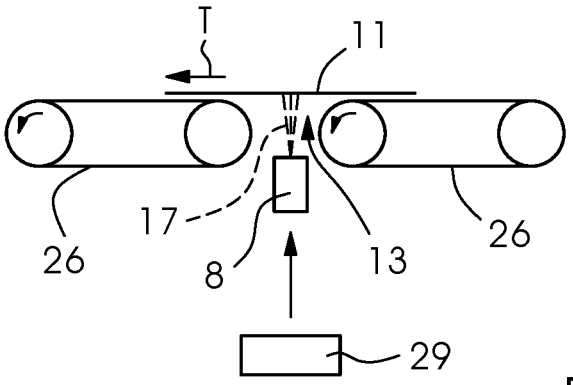
FIG. 5 is an illustration showing a modification wherein a sheet-guiding device is replaced by two conveyor belts.

FIG. 5 illustrates a modification of the sheet-fed printing machine 1. Here, the opening 13 is delimited by two conveyor belts 16 transporting the print sheet 11 and connected behind one another in the direction of sheet transport T. The humidification device 8 is only schematically shown and may be configured like the humidification device 8 shown in FIGS. 2A to 3B. What is shown is an electronic control 29 that controlsthe humidification device 8 in such a way that the jetting of dampening fluid occurs in accordance with the conveying cycle of the print sheets 11 and is interrupted whenever a sheet gap passes. For this purpose, the control 29 may actuate the drive 23 of the cyclic cover. In an exemplary embodiment that will be described in more detail below, the control unit 29 may actuate an actuator that alternately directs the feed line 22 towards the spin tray 16 and away from the latter.

Modifications that are not shown in the drawing may include replacing one of the two conveyor belts 26 by a guide plate whose guide surface is coplanar with the upper strand of the remaining conveyor belt 26. In this case, the sheet handling device including the opening 13 would consist of a guide device (guide plate) and a transport device (conveyor belt). In contrast to this, in FIGS. 2A and 3A, the sheet handling device including the opening 13 only consists of a guide device, which may in turn consist of one or two guide plates and guide device, and in FIG. 5, the sheet handling device including the opening 13 only consists of a transport device, which in turn consists of two conveyor belts, one of which transfers the print sheets 11 to the other.

Figure 6A:
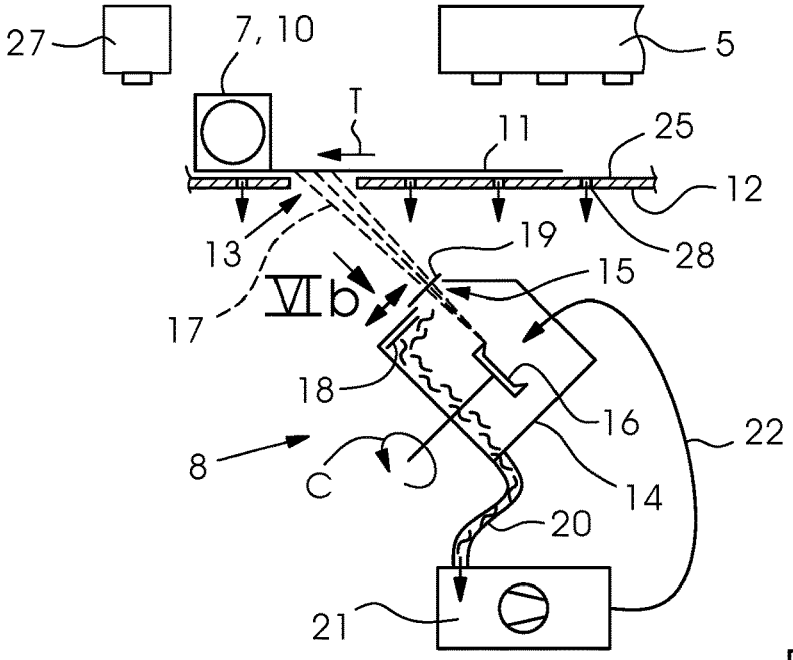
FIGS. 6A to 7B are illustrations of different views and positions of a second exemplary embodiment of the humidification device.
Figure 6B:
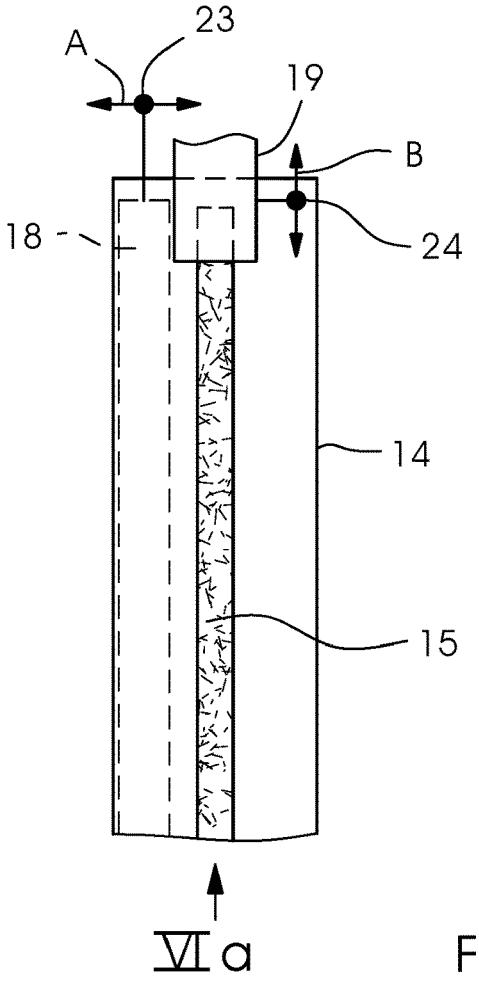
Figure 7A:
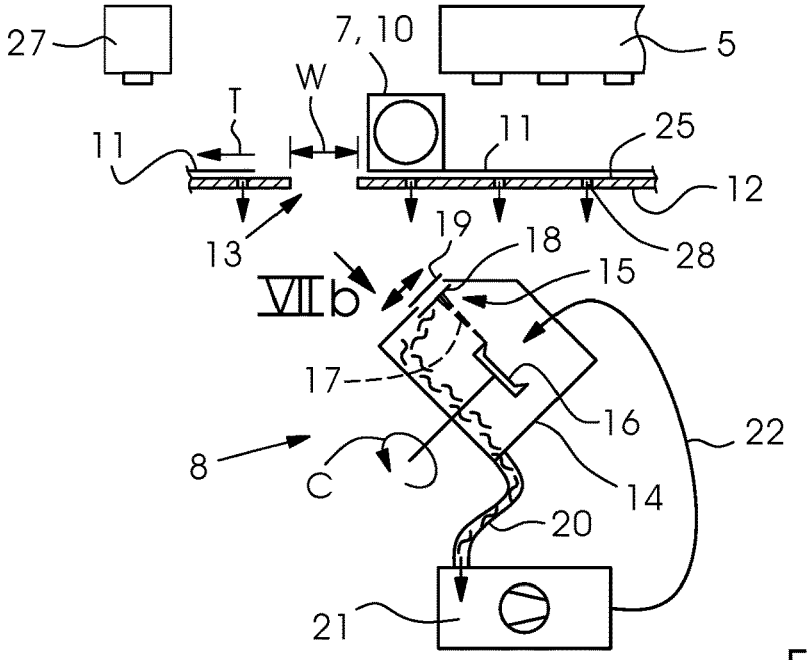
Figure 7B:
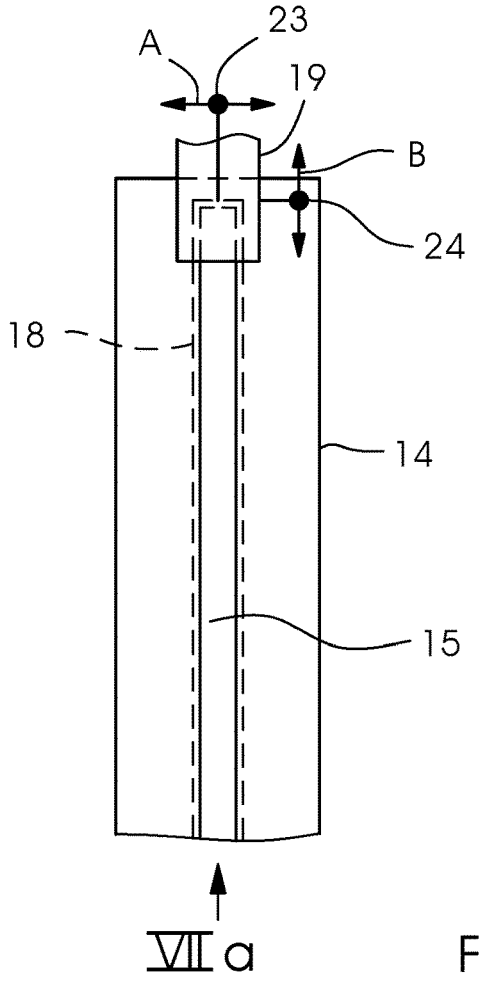

FIGS. 6A and 6B (cycle phase) and FIGS. 7A and 7B (channel phase) illustrate a modified version of the humidification device 8 of the sheet-fed printing machine 1 of FIG. 1. The differences between the version of these figures and the version of FIGS. 2A to 3B will be explained below. The features that the two versions have in common will not be explained again in the context of FIGS. 6A to 7B because they are easy to recognize in the drawing due to the reference symbols.

In FIGS. 6A and 7A, the nozzles 28 that are formed in the guide surface 25 to pneumatically guide the print sheets 11 and have been mentioned above in the context of previous version are visible in the drawing. The arrow symbols indicate that in this case, the nozzles 28 are suction nozzles. Yet it is possible for the nozzles 28 to be blowing nozzles or a combination of suction nozzles disposed next to blowing nozzles or hybrid nozzles that may be switched from suction operation to blower operation.

The viewing direction of FIG. 6A is direction VIa and the viewing direction of FIG. 6B is direction VIb. In an analogous way, the viewing directions of FIG. 7A and FIG. 7B are directions VIIa and VIIb, respectively. A difference between the two versions is the spraying direction of the humidification device 8. It is true that the spray jet 13 is inclined relative to the direction of sheet transport T in both versions, but in the version in accordance with FIGS. 2A to 4, the inclination is against the direction of sheet transport T (at an obtuse angle) and in the version in accordance with FIGS. 6A to 7B, the inclination is towards the direction of sheet transport T (at an acute angle).

FIGS. 6A and 7A illustrate a common feature that has not yet been mentioned but is present in all exemplary embodiments that have the dimensions explained below. This common feature is an opening width W of the opening 13 to be measured in a direction parallel to the direction of sheet transport T. At the maximum, this opening width W is 30% of the sheet length of the maximum format of print sheets 11 processable in the machine 1; this feature is advantageous in terms of only little effect on sheet travel. If the opening 13 has the shape of a slot-shaped window that is formed in the guide plate in a case in which the guide device only consists of a guide plate, the opening width W may, for instance, correspond to the slot width. In the case of a guide device 12 that consists of two guide plates arranged in a row, the opening with W may correspond to the edge distance between the rear edge of the front guide plate and the front edge of the rear guide plate.

Figure 8:
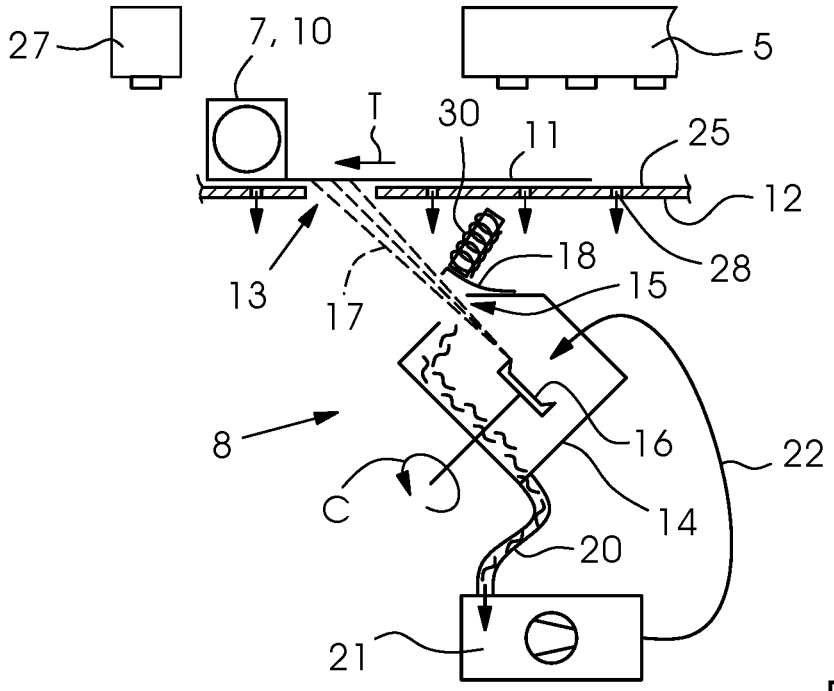
FIGS. 8 and 9 are illustrations showing different positions of a third embodiment of the humidification device.
Figure 9:
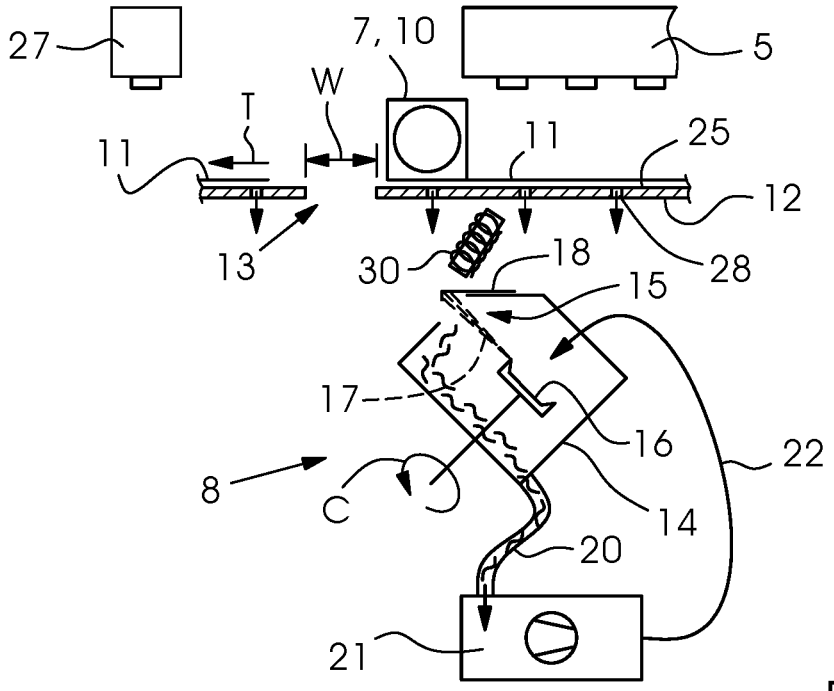

FIGS. 8 (cycle phase) and 9 (channel phase) illustrate a modified version of the cyclic cover 18. In the aforementioned exemplary embodiments, the cyclic cover 18 was embodied as a slide. In contrast, the cyclic cover 18 shown in FIGS. 8 and 9 is embodied as a rocker. The cyclic cover 18 does not fully close the spray opening 15 yet closes it sufficiently far for the spray jets 17 to be stopped by the cyclic cover 18 in the channel phase and for the dampening fluid to be directed into the housing 14. The cyclic cover 18 is embodied as a leaf spring and has a flexure joint. An actuator in the form of a solenoid 30 moves the cyclic cover 18 from its closing position in which it stops the spray jets 17 as shown in FIG. 4 into the release position in which it lets the spray jets 17 past unhindered as shown in FIG. 8. For this purpose, either the cyclic cover 18 itself consists of a material that may be magnetically attracted by the solenoid 30 or a piece of such a material is fixed to the cyclic cover 18. The control 29 actuates the solenoid 30 as a function of the conveying cycle K7 to generate the required spray cycle K8. When the control 29 deactivates the solenoid 30, the resetting of the cyclic cover 18 into the closing position occurs automatically by means of the cyclic cover itself 18 as a result of the bending elasticity thereof. The cyclic cover 18 comes off the solenoid 30 and snaps back into the closing position as soon as the solenoid 30 is no longer powered.

A modification is possible in which the cyclic cover 18 embodied as a rocker is rotatable about a rotary joint instead of the flexure joint. In this modification, the cyclic cover 18 does not have to be made of a bending-elastic or flexible plate or the like; instead, a reset spring, e.g. a tension spring may be provided to reset the cyclic cover 18 to the closing position. The reset spring may be dispensed with if an actuator such as a pneumatic cylinder alternately pivots the cyclic cover 18 into the release position and into the closing position. Apart from the fact that the cyclic cover 18 is embodied as a pivoting cover, the exemplary embodiment shown in FIGS. 8 and 9 corresponds to the exemplary embodiment shown in FIGS. 6A to 7B. For reasons of clarity, the format cover 19 is not shown in FIGS. 8 and 9 although the format adjustment device is present in these figures, too.

Figure 10:
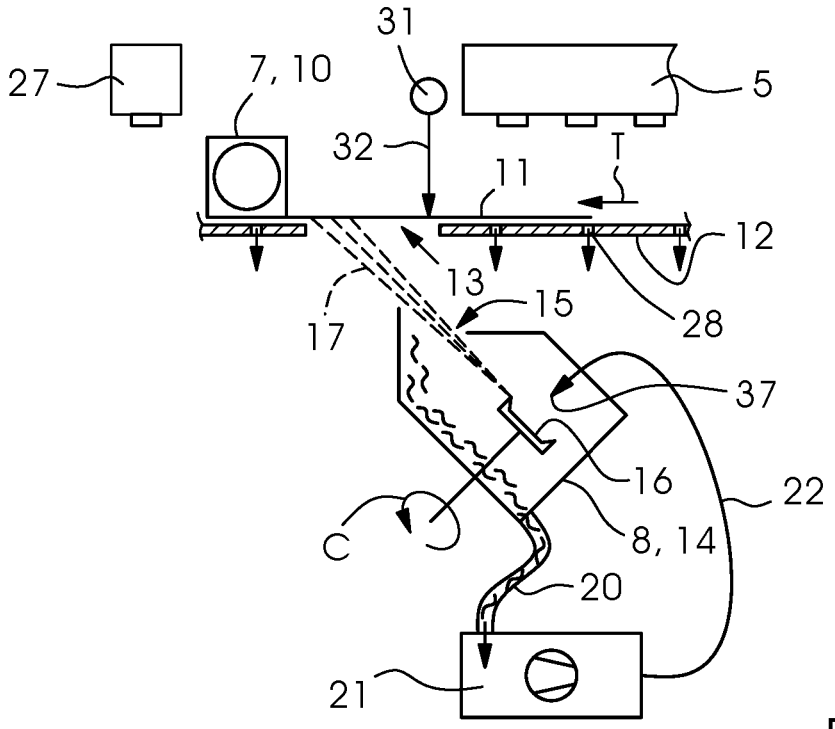
FIGS. 10 and 11 are illustrations showing different operating phases of a fourth exemplary embodiment of the humidification device.
Figure 11:
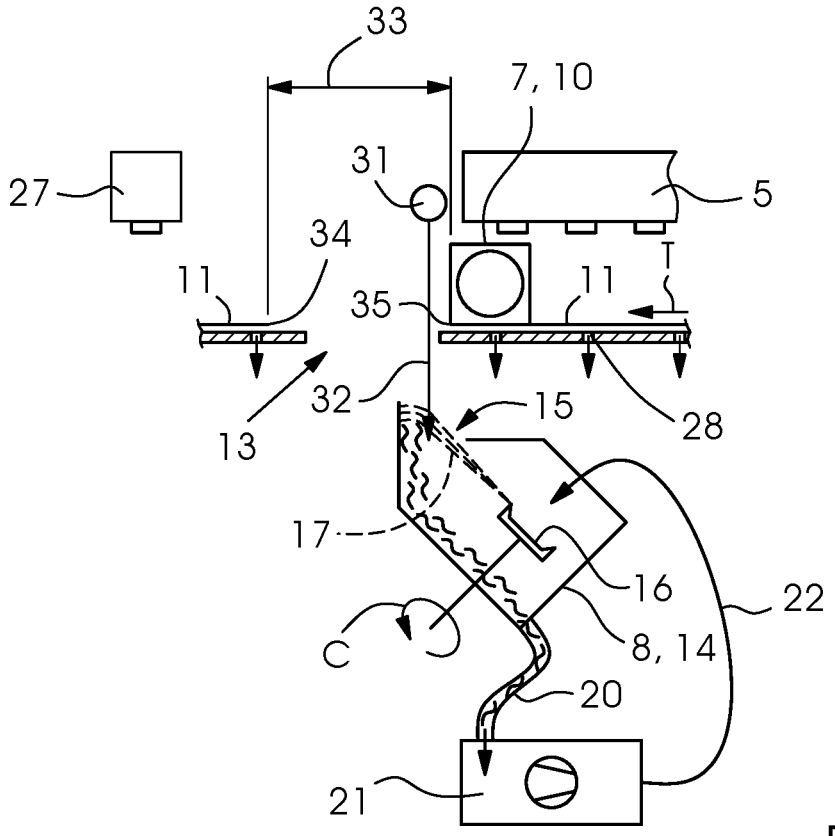

FIGS. 10 (cycle phase) and 11 (channel phase) show an exemplary embodiment that differs from the one described above only in that there is no cyclic cover 18 but a blower device 31 instead. The blower device 31 is disposed on a side of the print sheet 11 transport path, which is defined by the gripper bar 10, namely on the side opposite the spin trays 16. The blower device 31 continuously emits a blown air jet 32 in the direction of the spray opening 15, i.e. during both the cycle phase and the channel phase. The blown-air jet 32 may be referred to as an air curtain and extends over the entire width of the maximum format of the print sheets 11. For this purpose, the blower device 31 has a nozzle slot or a row of nozzles of a corresponding length. During the cycle phase (FIG. 10), the blown-air jet 32 hits the passing print sheet 11, especially the top or front side thereof. During the channel phase (FIG. 11), the blown-air jet 32 first passes a sheet gap 33 between the trailing edge 34 of a passing print sheet 11 and the leading edge 35 of a following print sheet 11 held by the gripper bar 10 and then the opening 13. Finally, the blown-air jet 32 hits the spray jet 17 and diverts it into the housing 14. In this process, the blown-air jet 32 urges the spray jet 17 in a direction different from the original jetting direction, namely in a downward direction, in such a way that the spray jet 17 potentially no longer passes through the spray opening 15 or, as in the illustrated example, hits the inner side of the housing 14. For reasons of clarity, the format cover 19 is not shown in FIGS. 10 and 11 although the format adjustment device is present in these figures, too.

Figure 12:
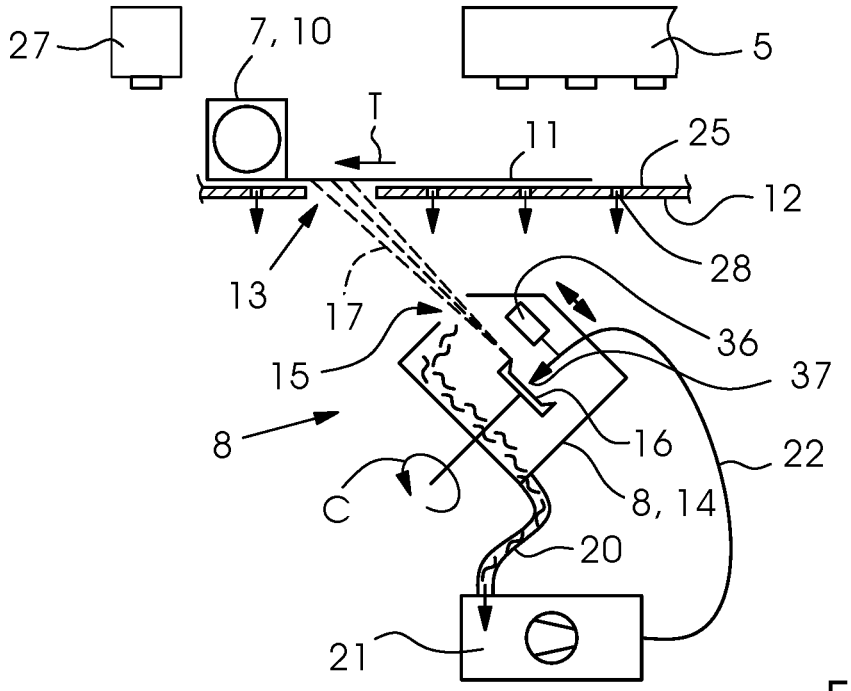
FIGS. 12 and 13 are illustrations showing different positions of a fifth exemplary embodiment of the humidification device.
Figure 13:
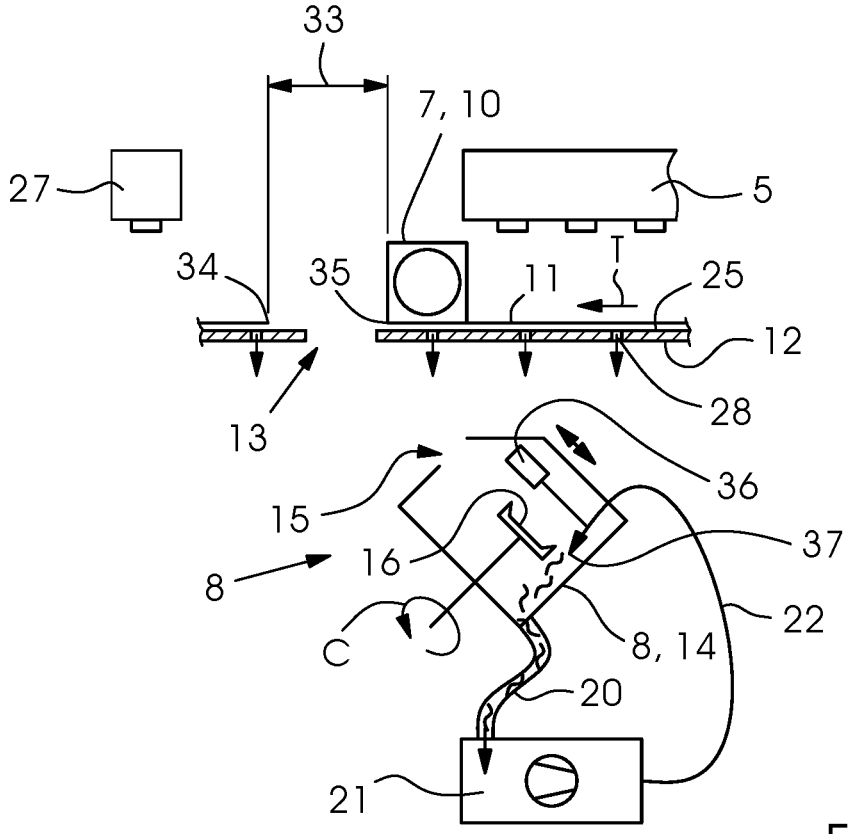

A further exemplary embodiment is shown in FIGS. 12 (cycle phase) and 13 (channel phase). In this embodiment, an outlet 37 of the feed line 22 is periodically adjustable between an active position (FIG. 12) and a passive position (FIG. 13) by means of an actuator 36. The adjustment results in the spraying cycle K8 (cf. FIG. 4); for this purpose, the actuator 36 is actuated by the control 29 (cf. FIG. 5) as a function of the conveying cycle K7. The actuator 36 may be a pneumatic operating cylinder. At least sections of the feed line 22 may be a hose that is bent when it is adjusted back and forth by the actuator 36. Alternatively, at least sections of the feed line 22 may be a pipe that is displaced or pivoted when it is adjusted back and forth by the actuator 36. In its active position, the outlet 37 is oriented towards the spin tray 16 to apply the fluid exiting the outlet 37 to the spin tray 16; in its passive position, the outlet 37 is not oriented towards the spin tray 16 and emits the fluid past the spin tray 16 into the housing 14. If the spin tray 16 is arranged in a row with other spin trays 16 as explained above, every spin tray 16 is assigned an outlet 37 that may be adjusted back and forth, with the outlets 37 located at the ends of branches of the branched-off feed line 22. Every outlet 37 may be moved back and forth by an individual actuator 36; alternatively, a common actuator 36 may be provided for all outlets 37.

The following is a summary list of reference numerals and the corresponding structure used in the above description of the invention:

1—sheet-fed printing machine
2—sheet feeder
3—printing unit
4—ink jet print head
5—drier
6—sheet delivery
7—transport device
8—humidification device
9—sheet stack
10—Gripper bar
11—print sheet
12—guide device
13—opening
14—housing
15—spray opening
16—spin tray
17—spray jet
18—cyclic cover
19—format cover
20—exhaust line
21—pump
22—feed line
23—drive
24—drive
25—guide surface
26—conveyor belt
27—powdering device
28—nozzle
29—control unit
30—solenoid
31—blower device
32—blown-air jet
33—gap between sheets
34—trailing edge
35—leading edge
36—actuator
37—outlet
A translatory movement
B translatory movement
C rotation
K7 conveying cycle
K8 spraying cycle
T direction of sheet transport
W opening width

The invention claimed is:

1. A sheet-fed printing machine, comprising:
a printing unit;
a drier;
a sheet guide for transporting or guiding print sheets, said sheet guide having an opening formed therein and disposed downstream of said drier in a direction of sheet transport; and
a humidifier for rehumidifying the print sheets and disposed in such a way that said humidifier rehumidifies the print sheets through said opening, said humidifier having a format adjustment device for adapting a humidification width to a width of a respective format of the print sheets.

2. The sheet-fed printing machine according to claim 1, wherein said opening is defined by a window in said sheet guide or by a gap between two components of said sheet guide.

3. The sheet-fed printing machine according to claim 1, wherein said humidifier has a spray device.

4. The sheet-fed printing machine according to claim 1, wherein said drier is a thermal drier.

5. The sheet-fed printing machine according to claim 1, wherein said printing unit has an inkjet print head.

6. The sheet-fed printing machine according to claim 1, wherein said sheet guide has at least one sheet-guiding plate delimiting said opening.

7. The sheet-fed printing machine according to claim 1, wherein said sheet guide has at least one conveyor belt delimiting said opening.

8. The sheet-fed printing machine according to claim 1, wherein said format adjustment device has at least one format cover.

9. A sheet-fed printing machine, comprising:

a printing unit;

a drier;

a sheet guide for transporting or guiding print sheets, said sheet guide having an opening formed therein and disposed downstream of said drier in a direction of sheet transport; and a humidifier for rehumidifying the print sheets and disposed in such a way that said humidifier rehumidifies the print sheets through said opening, said humidifier having a timing device for generating a spraying cycle.

10. The sheet-fed printing machine according to claim 9, wherein said timing device has a cyclic cover.

11. The sheet-fed printing machine according to claim 9, wherein:

said humidifier has a housing and a feed line for feeding a fluid to said housing; and said timing device has an actuator for alternately aligning an outlet of said feed line into an active position and a passive position.

12. The sheet-fed printing machine according to claim 9, wherein:

said humidifier has a spray jet; and said timing device contains a blower that is directed towards said spray jet of said humidifier and, while a sheet gap between said print sheets passes, blows through said sheet gap against said spray jet in such a way that said spray jet is diverted.

13. A sheet-fed printing machine, comprising:

a printing unit;

a drier:

a sheet guide for transporting or guiding print sheets, said sheet guide having an opening formed therein and disposed downstream of said drier in a direction of sheet transport; and a humidifier for rehumidifying the print sheets and disposed in such a way that said humidifier rehumidifies the print sheets through said opening, said humidifier having a spin tray.

14. A sheet-fed printing machine, comprising:

a printing unit;

a drier;

a sheet guide for transporting or guiding print sheets, said sheet guide having an opening formed therein and disposed downstream of said drier in a direction of sheet transport, an opening width of said opening in the direction of transport is no more than 30% of a sheet length of a maximum processable format of the print sheets; and a humidifier for rehumidifying the print sheets and disposed in such a way that said humidifier rehumidifies the print sheets through said opening.

* * * * *